US007665180B2

(12) United States Patent
Haan

(10) Patent No.: US 7,665,180 B2
(45) Date of Patent: Feb. 23, 2010

(54) STEAM VACUUM CLEANER

(76) Inventor: Gyung-Hee Haan, 345-29, Gasan-Dong, Geumcheon-Gu, Seoul (KR)

( * ) Notice: Subject to any disclaimer, the term of this patent is extended or adjusted under 35 U.S.C. 154(b) by 76 days.

(21) Appl. No.: 12/061,209

(22) Filed: Apr. 2, 2008

(65) Prior Publication Data

US 2009/0100631 A1 Apr. 23, 2009

(51) Int. Cl.
*A47L 7/00* (2006.01)

(52) U.S. Cl. ..... 15/320; 15/327.2; 15/327.6; 15/350; 15/351; 15/353

(58) Field of Classification Search ..... 15/320–322, 15/327.1, 327.2, 327.6, 350, 351, 353; *A47L 7/00*
See application file for complete search history.

(56) References Cited

U.S. PATENT DOCUMENTS 5,513,415 A * 5/1996 Kent et al. ..... 15/320
5,887,313 A * 3/1999 Hanold et al. ..... 15/320
6,530,362 B1 * 3/2003 Yanagii ..... 123/442

* cited by examiner

*Primary Examiner*—David A Redding
(74) *Attorney, Agent, or Firm*—Law Office of Michael N. Cohen, P.C.; Michael N. Cohen

(57) ABSTRACT

A steam vacuum cleaner includes a main assembly functioning as a mopstick, and the main assembly has an exhaust duct with a built-in filter formed at a rear face thereof.

2 Claims, 15 Drawing Sheets

STEAM VACUUM CLEANER

CROSS-REFERENCE(S) TO RELATED APPLICATIONS

The present invention claims priority of Korean patent application number 10-2007-0032448, filed on Apr. 2, 2007, which is incorporated by reference in its entirety.

BACKGROUND OF THE INVENTION

The present invention relates to a steam vacuum cleaner including a main assembly that functions as a mopstick, the main assembly having an exhaust duct with a built-in filter formed at a rear face thereof.

Korean utility model registration Nos. 20-0404402 and 20-0413652 and Korean patent application publication No. 10-2007-0027895 disclosed a steam vacuum cleaner where a dust collection bin, a suction motor, and a steam generator are all installed in the main body. Because of this, the main body of the related art steam vacuum cleaner has a certain height, making it difficult to clean under the bed or the couch.

Besides, the main body of the related art steam vacuum cleaner is bulky and wide such that its contact area with the floor is large. As the contact resistance requires a bit more force to move (e.g., push and pull) the cleaner, a user feels more difficult to clean with this type of cleaner.

Moreover, the related art steam vacuum cleaner is built in a manner that ventilation air of the suction motor comes out from behind the main body to blow away the dust on the floor.

In addition, since the dust collection bin only has a function of collecting dust, the filter installed at a suction opening of the motor is often clogged up. This shortens the cleaning cycle of the filter and another inconvenience for the user is posed.

Still another adverse effect of the related art steam vacuum cleaner is that when in use for steam cleaning and/or vacuum cleaning, it is highly possible that the sucked-up steam enters the motor and causes an electrical short.

In addition, whether the dust collection bin is installed inside or outside the main body, its particular shape makes it difficult to take out.

Lastly, the related art steam vacuum cleaner uses a motor is designed to suck air in from the front and discharge the air to a rear side. Therefore, its low cooling efficiency had to be compensated by installing a motor with a relatively large capacity.

SUMMARY OF THE INVENTION

To address deficiencies of the related art, it is, therefore, an object of the present invention to provide a steam vacuum cleaner capable of filtering fine dust and at the same time reducing air discharge rate to prevent the dust from scattering by the discharged air flow.

In accordance with the present invention, there is provided a steam vacuum cleaner, comprising: a base assembly; a main assembly; and a neck assembly for connecting the main assembly rotatable with respect to the base assembly, wherein the main assembly is provided with an exhaust duct to exhaust discharged air from the base assembly to outside via the neck assembly, the exhaust duct comprising an exhaust groove formed at the main assembly, a filter mounted to the exhaust groove, and a filter cover for opening/closing the exhaust groove.

The steam vacuum cleaner with this configuration is advantageously used for filtering fine dust and reducing air discharge rate at the same time such that the dust may not be scattered by the discharged air flow.

In an exemplary embodiment, the filter cover is composed of a cover plate provided with an exhaust hole, a detachable projection formed at the upper and lower faces of the cover plate to be lodged into a locking groove formed at the upper and lower faces inside the exhaust groove, and an operation unit for operating the detachable projection. Since both the detachable projection and the locking groove are formed inside the exhaust groove, a structure like a recessed groove is not seen from outside and an aesthetic value of the cleaner is therefore enhanced.

The other objectives and advantages of the invention will be understood by the following description and will also be appreciated by the embodiments of the invention more clearly. Further, the objectives and advantages of the invention will readily be seen that they can be realized by the means and its combination specified in the claims.

DESCRIPTION OF SPECIFIC EMBODIMENTS

Hereinafter, preferred embodiments of the present invention will be set forth in detail with reference to the accompanying drawings so that those skilled in the art can easily carry out the invention.

Figure 1:
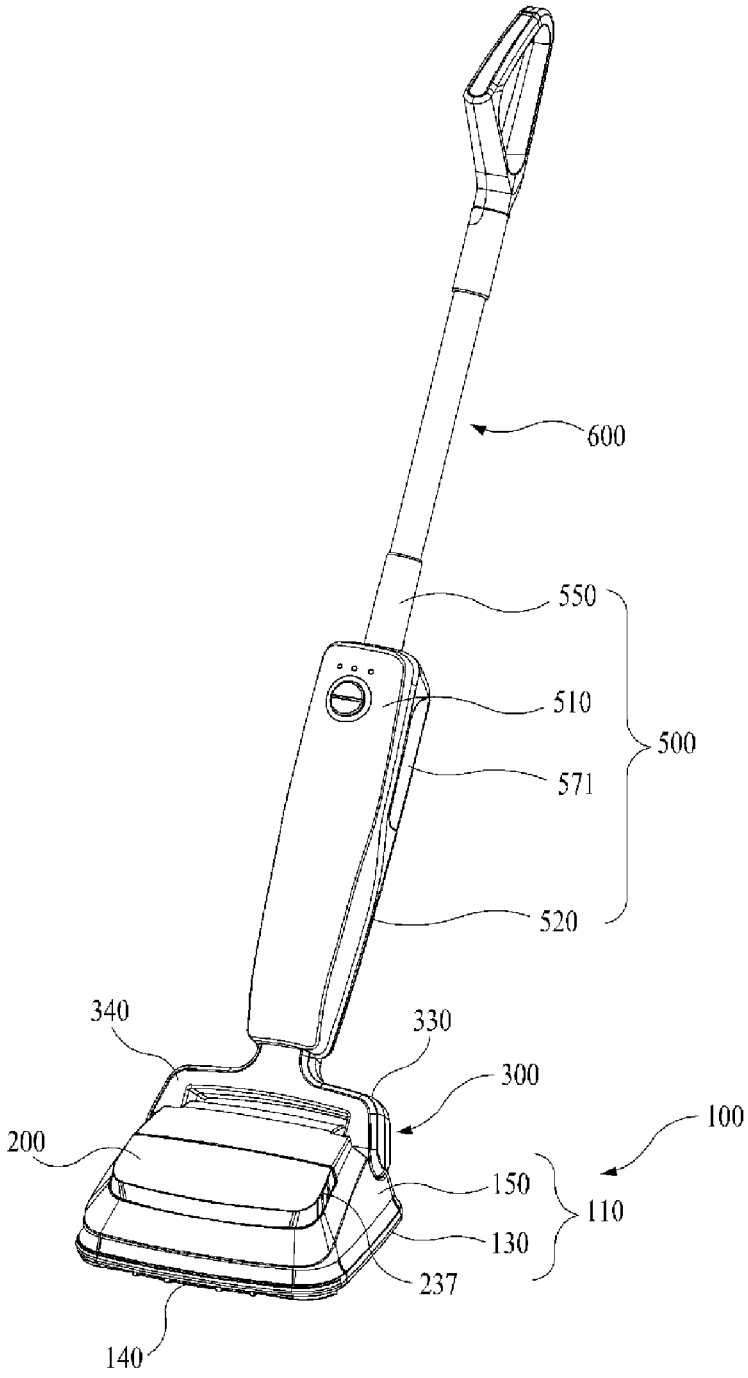
FIG. 1 is a front perspective view of a steam vacuum cleaner according to a preferred embodiment of the present invention.
Figure 2:
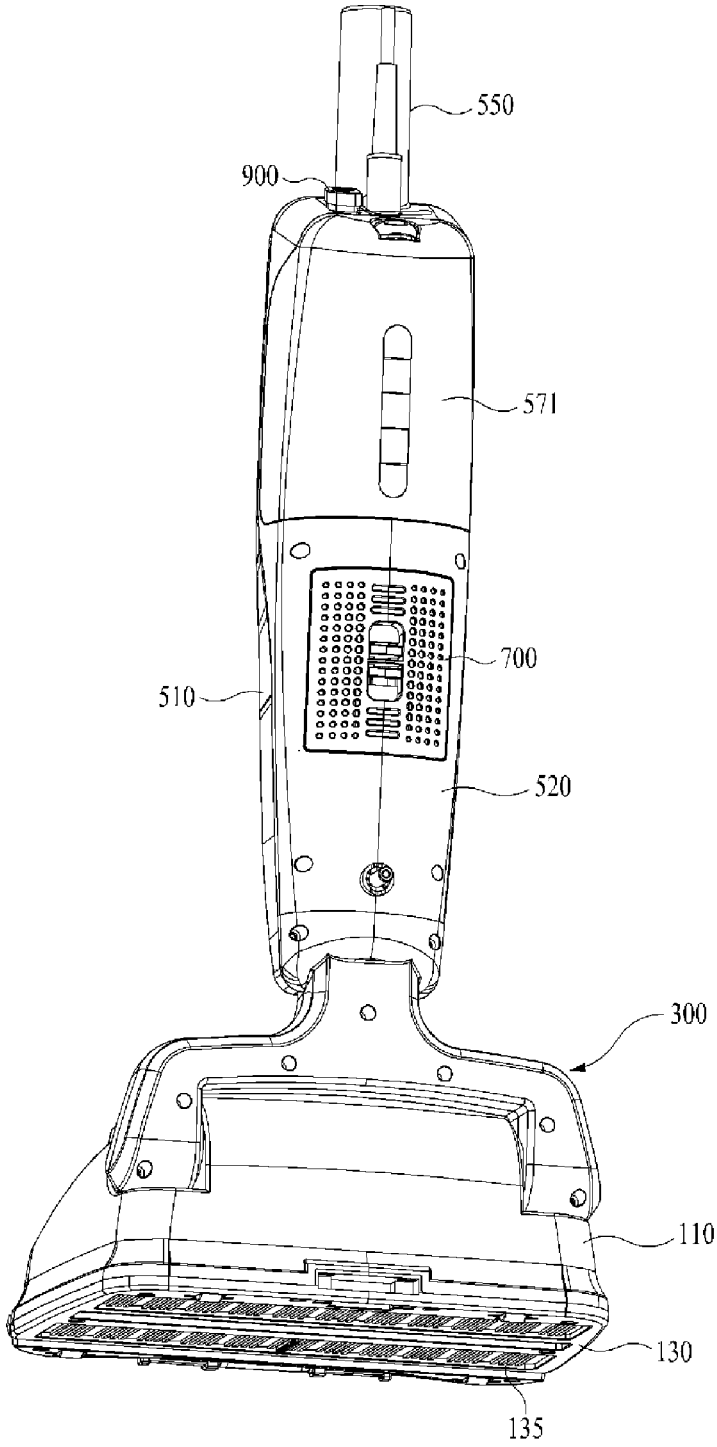
FIG. 2 is a rear perspective view of FIG. 1.

FIG. 1 is a front perspective view of a steam vacuum cleaner according to a preferred embodiment of the present invention, and FIG. 2 is a rear perspective view of FIG. 1.

Referring to the outer appearance shown in FIGS. 1 and 2, the steam vacuum cleaner of this embodiment is largely constituted by a base assembly 100, a main assembly 500, and a neck assembly 300 connecting between the base assembly 100 and the main assembly 500.

The min assembly 500 has a pipe 550 (to be described) to which a length-adjustable mop handle 600 is connected in a detachable manner. The mop handle 600 is composed of a telescopic stick and a handle.

Figure 3:
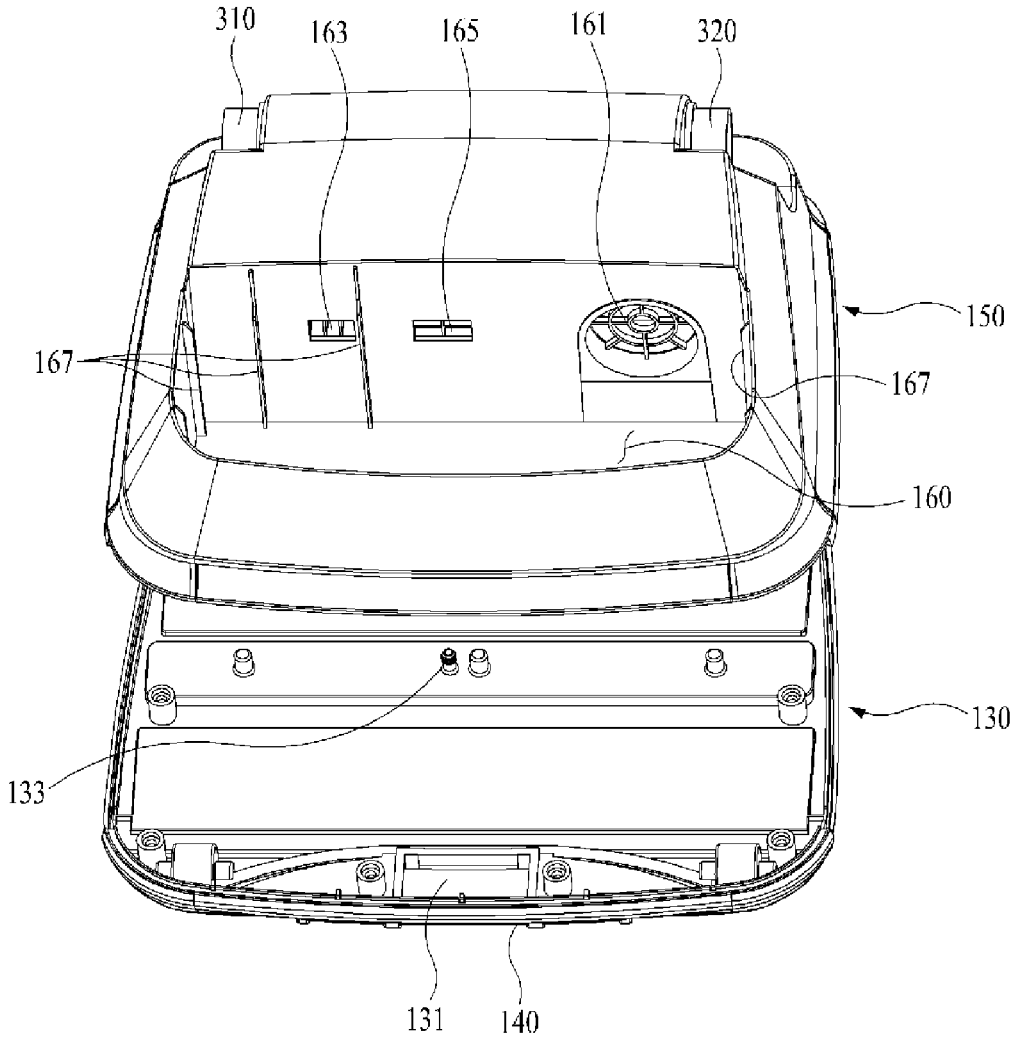
FIG. 3 is an exploded perspective view of a base assembly having a dust collection bin being removed therefrom.
Figure 4:
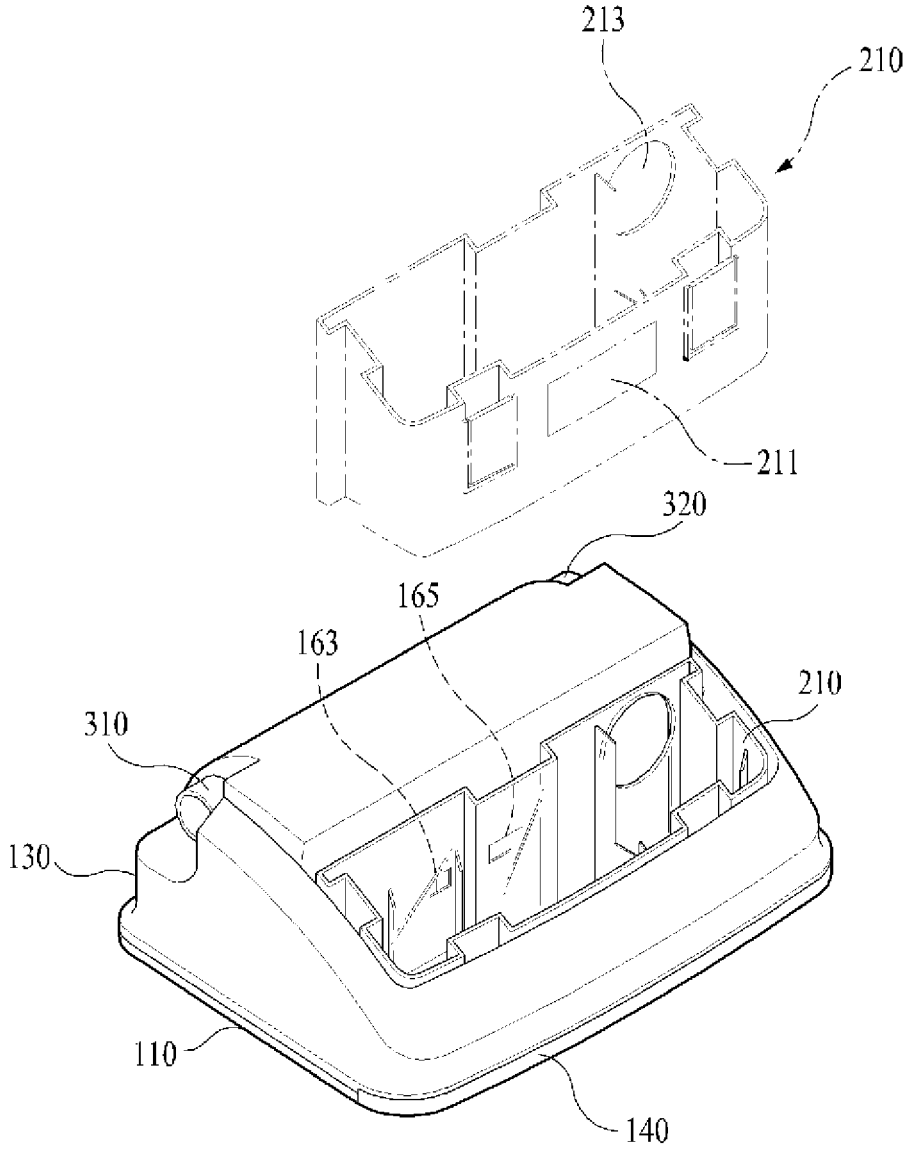
FIG. 4 is an exploded perspective view of the base assembly having a dust collection bin being installed therein.
Figure 7:
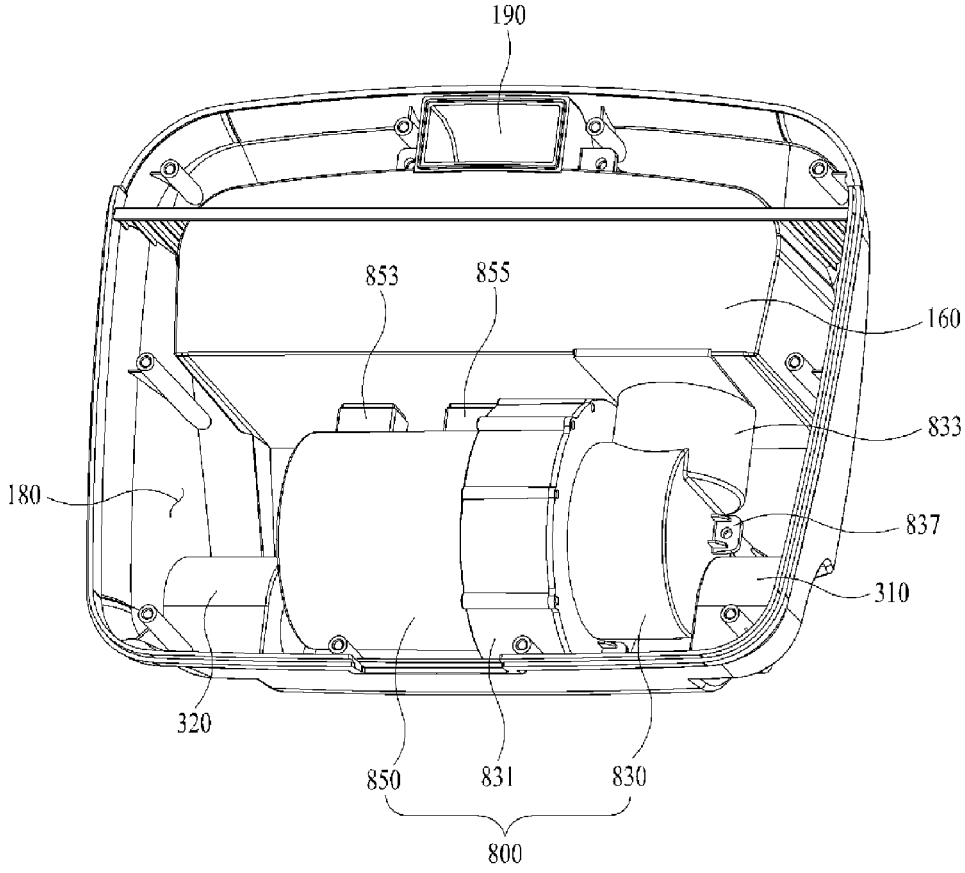
FIG. 7 is a bottom perspective view of FIG. 6 having a bedplate being removed therefrom.

The base assembly 100, as depicted in FIG. 3, FIG. 4, and FIG. 7, is composed of a main body 110 including a bedplate 130 and an upper cover 150, and a vacuum cleaning section installed at the main body 110.

Referring to FIG. 3, the bedplate 130 is provided with a suction nozzle 131 in front and a steam ejection port 133 in rear.

The bottom area around the steam ejection port 133 forms a Velcro type adhesive face 135 to which a pad is attached for cleaning.

The steam ejection port 133 is connected to a steam generator 570.

Front frame of the bedplate 130 is preferably formed of a bumper 140 made of elastic materials like rubber or plastic, such that the main body 110 can be protected as much as possible from breaking and cracks due to collision with the wall during cleaning.

A dust collection bin mount groove 160 to which a dust receptacle 200 is mounted is formed at the front upper side of the upper cover 150, and a motor mount groove 180 to which a suction motor 800 is mounted is formed at the rear lower side of the upper cover 150.

The front face of the dust collection bin mount groove 160 has a suction duct 190 to which a suction nozzle 131 and an inlet 211 of a dust collection bin 210 (to be described) are connected.

The rear side of the dust collection bin mount groove 160 has a first through hole 161 where an impeller casing 830 of the suction motor 800 is arranged, a second through hole 163 where a cold air intake duct 853 (to be described) is arranged, and a third through hole 165 where air exhaust duct 855 (to be described) is arranged.

Preferably, the dust collection bin mount groove 160 further has a rib 167 that functions to fasten the dust collection bin 210 to some degree, leaving a small space between the inner circumference face of the dust collection bin mount groove 160 and the outer circumference face of the dust collection bin 210.

Therefore, this space serves as a channel for cold air to enter the cold air intake duct 853 and hot air to flow out from the air exhaust duct 855.

Especially, since the air exhaust duct 855 is disposed facing the rear side of the dust collection bin mount groove 160, hot air therefrom collides with the dust collection bin mount groove 160.

Therefore, a whirr sound of the air getting blown out through the space is reduced and a minimal amount of floor dust is scattered around by the exhausted air.

The upper cover 150 has hollow hinges 310 and 320 formed at both sides of it rear portion. The hinges 310 and 320 are formed in communication with the motor mount groove 180. To these hinges 310 and 320 is the neck assembly 300 (to be described) connected rotatably.

Therefore, suction air coming out of the motor assembly 800 is exhausted outside through an exhaust section 700 of the main assembly 300 via the hinges 310 and 320 in the motor mount groove 180 and then neck cases 330 and 340 of the neck assembly 300.

Figure 5A:
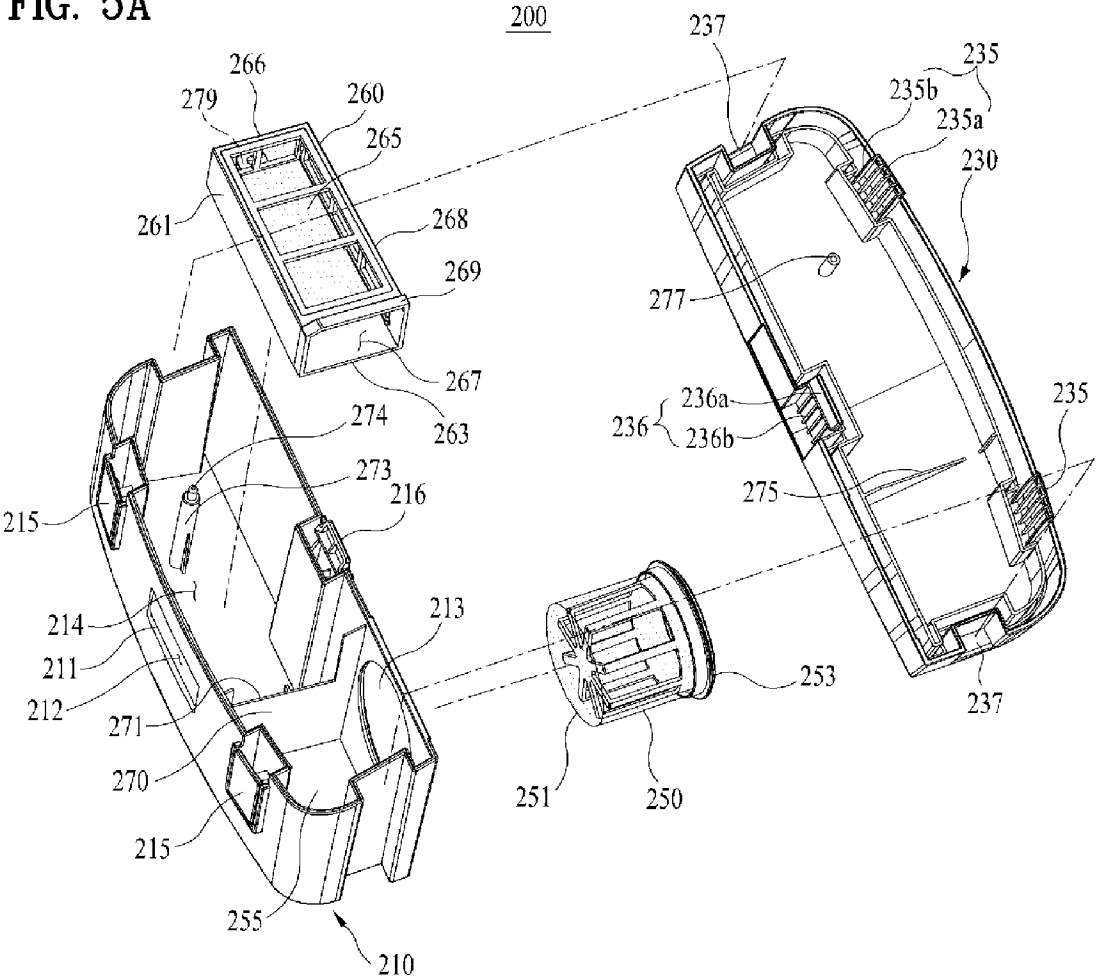
FIG. 5*a* is an exploded perspective view of a dust receptacle.
Figure 5B:
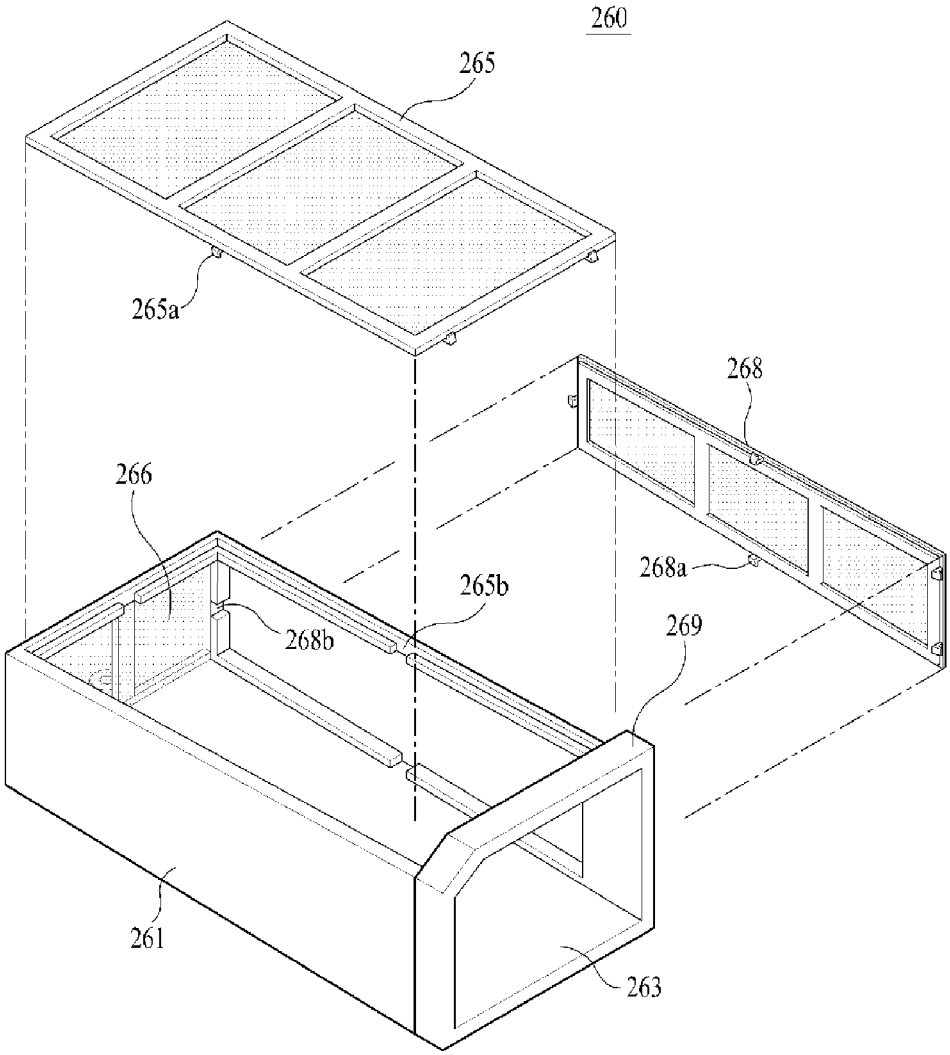
FIG. 5*b* is an exploded perspective view of an auxiliary filter.
Figure 6:
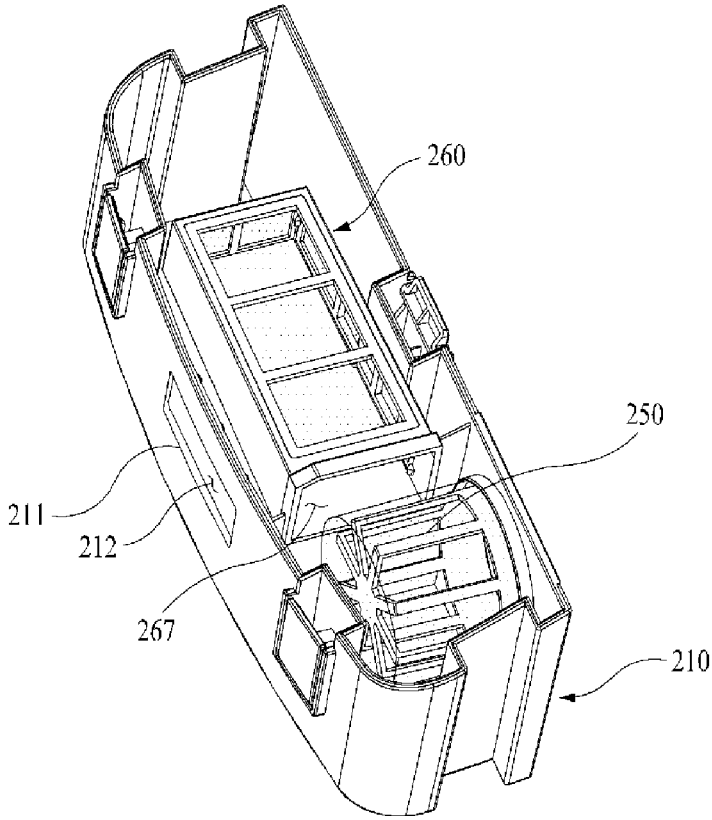
FIG. 6 is an assembled perspective view of a dust receptacle without a cover.

The dust receptacle 200, as depicted in FIGS. 4 through 6, includes the dust collection bin 210 detachably mounted to the dust collection bin mount groove 160, and a cover 230 for opening/closing the dust collection bin 210.

With the cover 230 on the top, water or steam, although this may have flown into the dust collection bin 210, rarely leaks from out of the bin.

The front face of the dust collection bin 210 has a bin inlet 211 to be connected with the duct 190, and the rear face of the dust collection bin 210 has a filter mount opening 213 to accept a main filter section 250.

The bin inlet 211 preferably has a door 212 that is open by the force of air being sucked in and closed by the gravity when the force disappears.

The operating mechanism of the door 212 stops dust flying away from the bin inlet 211 when the cleaner is not in use.

The filter mount opening 213 functions as a ventilation/exhaust outlet for guiding the air having passed through the main filter section 250 towards the suction motor.

In addition, hanger pieces 215 and 216 are formed at the front and rear faces of the dust collection bin 210. In correspondence to thereto, safety bars 235 and 236 are formed at the front and rear faces of the cover 230.

The hanger pieces 215 and 216 are installed in a manner that the major axes at both sides of the center can rotate about the dust collection bin 210.

With respect to the major axis, a spring is inserted below the major axis and a stopper is provided above the major axis. Therefore, when the hanger piece 215 or 216 below is pressed down, the spring is compressed for seesaw operation with an upper portion being rushed out and the hanger piece 235 or 236 is rendered in the lock released state. Meanwhile, when the hanger piece 215 or 216 is released, it returns to its original position by spring force.

The stopper checks extreme rotations of the hanger pieces 215 and 216 by the resilient force of the spring, and guides them to go to their original positions parallel to each other.

The safety bar 235 is composed of a locking jaw 235*a* and a support piece 235*b*. In particular, the support piece 235*b* is formed into a rib. When the hanger piece 215 is locked on the locking jaw 235*a*, the rib shape support piece 235*b* makes a line contact with the dust collection bin 210 so that one can easily engage or disengage it without much effort.

The hinge structure for the hanger pieces 215 and 216 facilitates opening and closing of the dust collection bin 210. That is, a user simply pushes the cover 230 down to connect it to the dust collection bin 210. Meanwhile, the user opens the cover 230 simply by pressing the hanger piece 215 or 216 and rotating the cover 230 toward the hanger piece 215 or 216.

As the cover 230 is opened or closed easily and smoothly, the dust collection bin does not shake when the user opens the cover, such that dusts kept in the dust collection bin do not easily fly out of the bin.

The cover 230 is preferably exposed outside to help the user take out the dust receptacle 200 more conveniently.

To help the user pull out the dust receptacle 200 even more conveniently, a lift groove 237 is formed at both sides of the cover 230. The lift groove 237 is recessed in an L shape in size of a finger.

The main filter section 250 is mounted to the filter mount opening 213 of the dust collection bin 210. The main filter section 250 is composed of a main filter 251 and a filter support frame 253 to support the main filter 251.

The main filter 251 filters the air having passed through the dust collection bin 210 into the motor assembly 800. The main filter 251 is made of a fabric and adhered onto the filter support frame 253.

The dust collection bin 210 preferably has an auxiliary filter 260. Referring to FIG. 5*a*, the auxiliary filter 260 has a rectangular shape, in which front face 261 and bottom face 263 are shut, top face 265, left lateral face 266 and rear face 268 have a screen form, and light lateral face 267 is open.

The front face 261 and the bottom face 263 are arranged at an upper portion of the bin inlet 211 to be faced with each other. In this way, incoming dust, particularly coarse dust, can be led to and accumulated in areas other than the front face 261 and the bottom face 263.

The right lateral face 267 is disposed to face the main filter section 250.

The top face 265 and the rear face 268 are configured in a detachable manner, as depicted in FIG. 5*b*. To be more specific, detachable projections 265*a* and 268*a* formed at the top screen 265 and the rear screen 268 are detachably inserted into grooves 265*b* and 268*b* formed at the frame of the auxiliary filter 260. These are conveniently used for assembly or cleaning.

Optionally, the front face 261, the bottom face 263, and the left lateral face 266 can be made as separable individual elements, and the front face 261 and the bottom face 263 can take a screen structure as well.

The auxiliary filter 260 is formed into a trapezoidal shape having a gradually increasing surface area from left to right, so that air flow may not be bottlenecked and suction/exhaust efficiencies may be improved.

Hence, a mixture of coarse dust and fine dust accumulated in the dust collection bin 210 settles or is distributed evenly around the auxiliary filter 260, so the user does not need to empty the dust collection bin 210 too often. In particular, the fact that the accumulation of dust in the main filter 215 is discouraged as much as possible lightens the burden of emptying the dust receptacle frequently.

The auxiliary filter 260 is supported by a separator 270 and a support 273, the separator 270 isolating a mount chamber 255 to which the main filter section 260 is mounted from a dust collecting chamber 213.

The separator 270 preferably has a receiving groove 271 to receive a lower portion of the front face 261 of the auxiliary filter therein.

An insertion protrusion 274 is formed at the upper end of the support 273 to be inserted into an insertion opening 279 formed at the left hand side of the auxiliary filter 260 for support.

To prevent the auxiliary filter 260 from being separated upwardly, a pressing piece 257 to press a right lateral top face 269 of the auxiliary filter 260, and an insertion groove 277 to press the insertion opening 279 being engaged with the insertion protrusion 274 are formed at an inner face of the cover 230.

Figure 8:
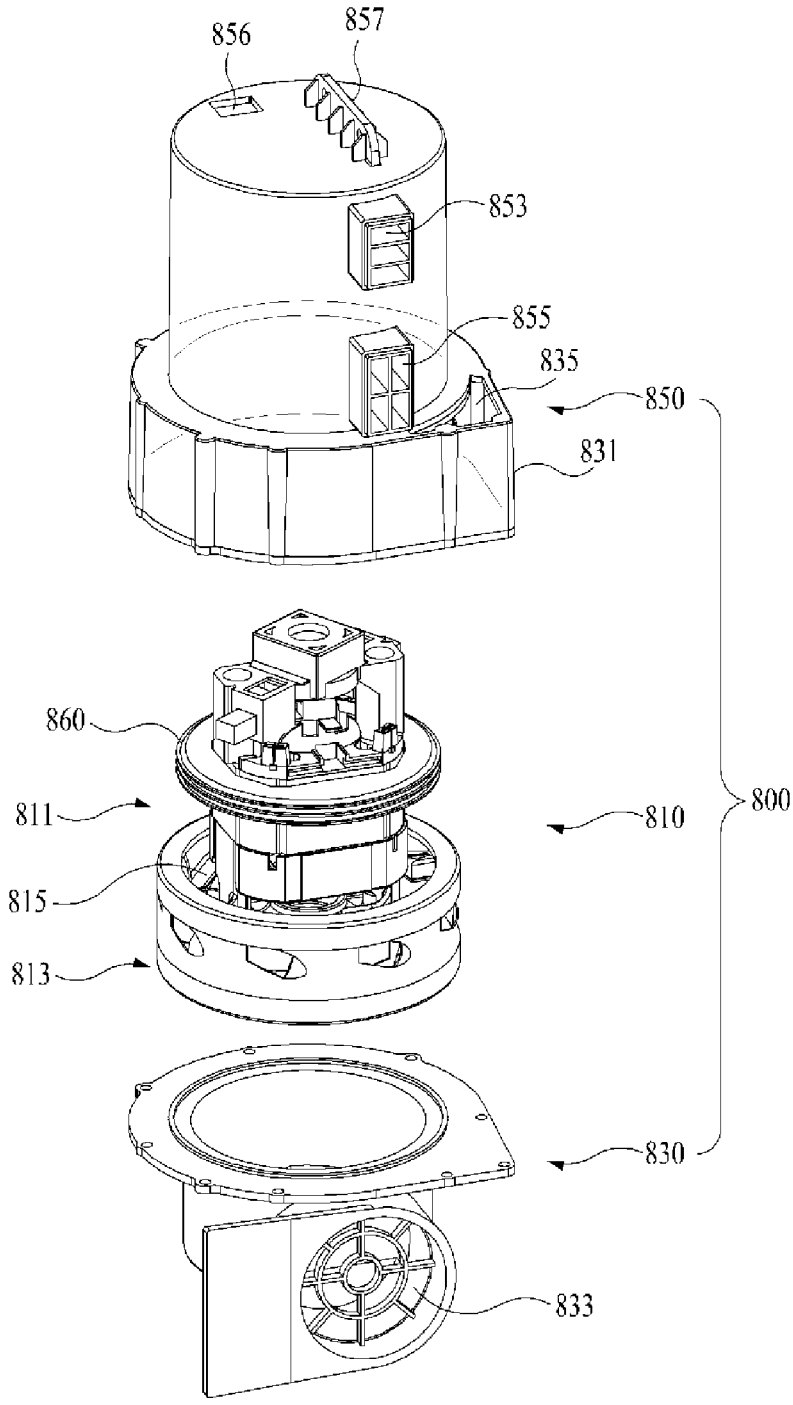
FIG. 8 is an exploded perspective view of a motor.
Figure 9:
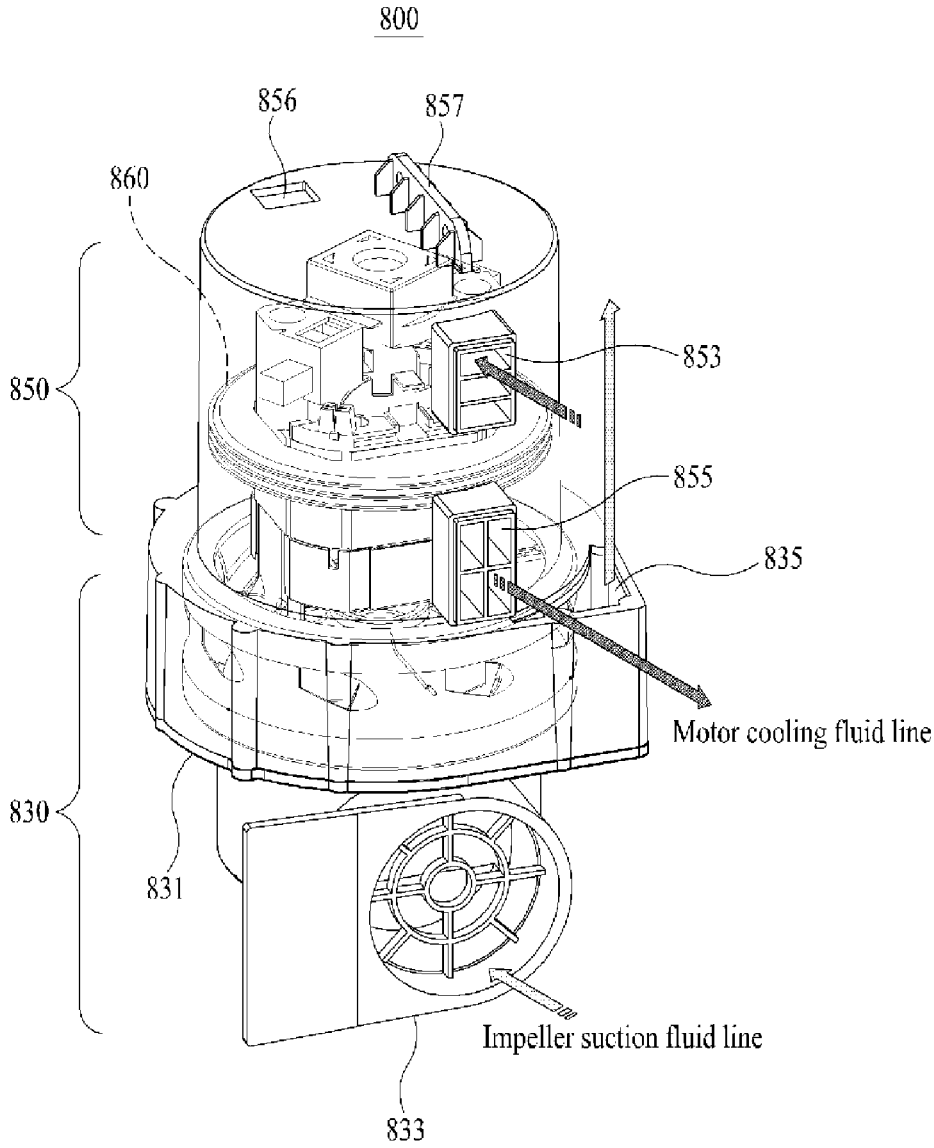
FIG. 9 is an assembled perspective view of FIG. 8.

Referring next to FIG. 8 and FIG. 9, the motor assembly 800 is constituted by a motor 810, an impeller casing 830, and a motor-cooling casing 850.

The motor 810 is composed of a motor drive unit 811 provided with a cooling fan, and an impeller 813 to receive power from the motor drive unit 811. The motor 810 is mounted to the motor mount groove 180, as depicted in FIG. 7.

The impeller 813 has a structure to suck air in the rotation axis direction and exhaust the air in the circumference direction, and it protects the motor drive unit 811 from moisture intrusion.

The impeller casing 830 is composed of a circumferential case 831 to enclose the impeller 813, a suction case 833 connected to the first through hole 161, and an exhaust port 835 formed at the circumferential case 831.

Because the exhaust port 835 stands at right angles to the circumference direction, the air being exhausted through the exhaust port 835 travels in a longitudinal direction of the motor drive unit 811, consequently improving cooling efficiency. The improvement in cooling efficiency opens up the possibility of using a motor 810 having a relatively small capacity. That is, a small size, light weighted, and low noise motor can be advantageously used for the cleaner.

The motor drive unit 810 further includes the motor-cooling casing 850. The motor-cooling casing 850 preferably has, in its circumference face, the cold air intake duct 853 connected to the second through hole 163, and the air exhaust duct 855 connected to the third through hole 165.

That is, when the cooling fan 815 of the motor drive unit 810 starts operating, cold air in the main body 110 is sucked into the cold air intake duct 853. This cold sucked air flows toward the cooling fan 815, taking away heat being produced. The heated air collides with the walls of the dust collecting bin 210 of the bin mount groove 160 in its way out through the air exhaust duct 855.

This cooling flow of the motor drive unit 810 makes it possible to carry out the high efficiency suction at a given capacity even if a smaller size motor 810 may have been utilized.

Moreover, since the hot air is exhausted after colliding with the walls of the dust collecting bin 210, less floor dust is scattered and the noise is reduced to lower levels.

Preferably, a flow separation packing 860 is further provided between the motor drive unit 810 and the motor cooling casing 850.

That is to say, when cold air enters the motor casing 850, it is led into the motor drive unit 810, and then hot air flows out of there along the outer circumference face of the motor drive unit 810 to be exhausted through the air exhaust duct 855. In this way, the incoming air and the exhausted air do not meet each other, and the cooling efficiency is therefore enhanced even more.

Especially, the motor cooling casing 850 is made of a transparent material as shown in FIG. 9 such that one can see assembly condition of the flow separation packing 860 with the naked eye.

Mount pieces 837 and 857 to be mounted to the motor mount groove 180 are formed at the suction case 833 and the motor cooling casing 850, respectively. The motor cooling casing 850 also have a cord withdrawal hole 856 from which a cord used for supplying power to the motor is extended.

Figure 10:
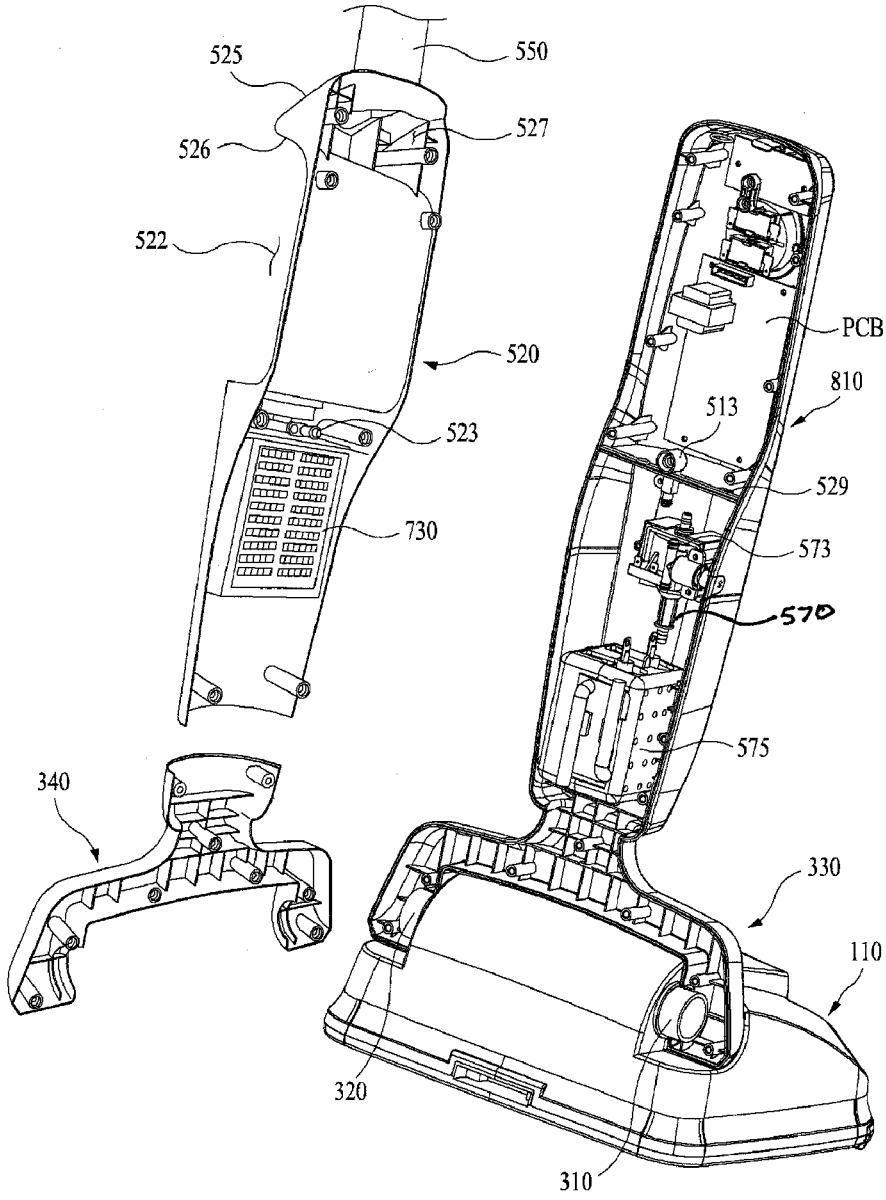
FIG. 10 is a rear perspective view showing the interior of a main assembly.

Referring next to FIG. 10, the neck assembly 300 is formed into a fork shape. The neck assembly 300 can be divided into a front neck case 330 and a rear neck case 340. Lower ends of both neck cases are connected by hinges 310 and 320, and upper ends thereof are connected to front and rear mount cases 510 and 520, respectively.

The neck cases 330 and 340, together forming an empty cylindrical case, serve as a guide passage to guide exhausted air from the motor to an exhaust section 700 (to be described) of the main assembly 500.

Each of the neck cases 330 and 340 includes a wire for connecting a PCB mounted in the main assembly 500 and the motor assembly 800, and a tube for connecting a heater 575 and a steam ejection port 133.

The front mount case 510 has a partition 529 for dividing the space into an area with the PCB and an area with a steam generator 570, such that the exhausted air may not flow towards the PCB.

Also, as shown in FIG. 10, the front neck case 330 is united with the front mount case 510 of the main assembly, while the rear neck case 340 is separated from the rear mount case 520.

Therefore, the rear mount case 520 is first assembled to the front mount case 510, and the rear neck case 340 is assembled to the front neck case 330 next. An outer lateral face of the lower end of the rear mount case 520 has a step height, while an inner lateral face of the upper end of the rear neck case 340 has a step height. Thus, these two cases are assembled to each other by bringing them in touch with each other.

Based on this assembly structure, the rear neck case 340 and the rear mount case 520 can be detached separately. As such, if the PCB or the steam generator 570 needs to be repaired, only the rear mount case 520 can be disassembled, improving after-sale service quality.

The main assembly 500 is composed of housings (i.e. the front mount case 510 and the rear mount case 520), and the steam generator 570 loaded at the housings.

The front mount case 510 is provided with the steam generator 570 except for a water bag 571 and the PCB. The water bag 571 is detachably installed at the rear mount case 520.

The steam generator 570 is composed of a water bag 571, a pump for pumping water in the water bag 571, and a heater 575 for heating the pumped water and generating steam. An instantaneous-heating type water heater is used for the heater 575.

The water bag 571 is detachably installed at a mount space 522 that is formed at the outer face of the rear mount case 520.

A fastening projection 571*a* that receives an elastic force towards the surface is formed at the upper face of the water bag 571, and a water discharge port 571*b* is formed at the lower face thereof.

The fastening projection 571*a* receiving an elastic force from springs built in the case 571 of the water bag 571 is projected toward the surface.

When the water bag 571 is placed at the mount space 522, the fastening projection 571*b* is inserted into a fastening opening 910, and a water inlet port 571*b* is connected to a (male) nipple 523. The male nipple 523 is insertedly coupled into a female nipple 513 connected to a pump 573. Therefore, when the front mount case 510 and the rear mount case 520 are connected, the female nipple 513 and the male nipple 523 are automatically connected. This feature represents improvements in assembly and connectability.

In addition, the rear face of the water bag 571 has an insertion groove 571 into which an insertion projection 521 formed at the mount space 522 is inserted, thereby ensuring a firm, stable installment.

Detaching the water bag 571 is made possible by a detachable member 900 installed at the rear mount case 520.

Figure 12:
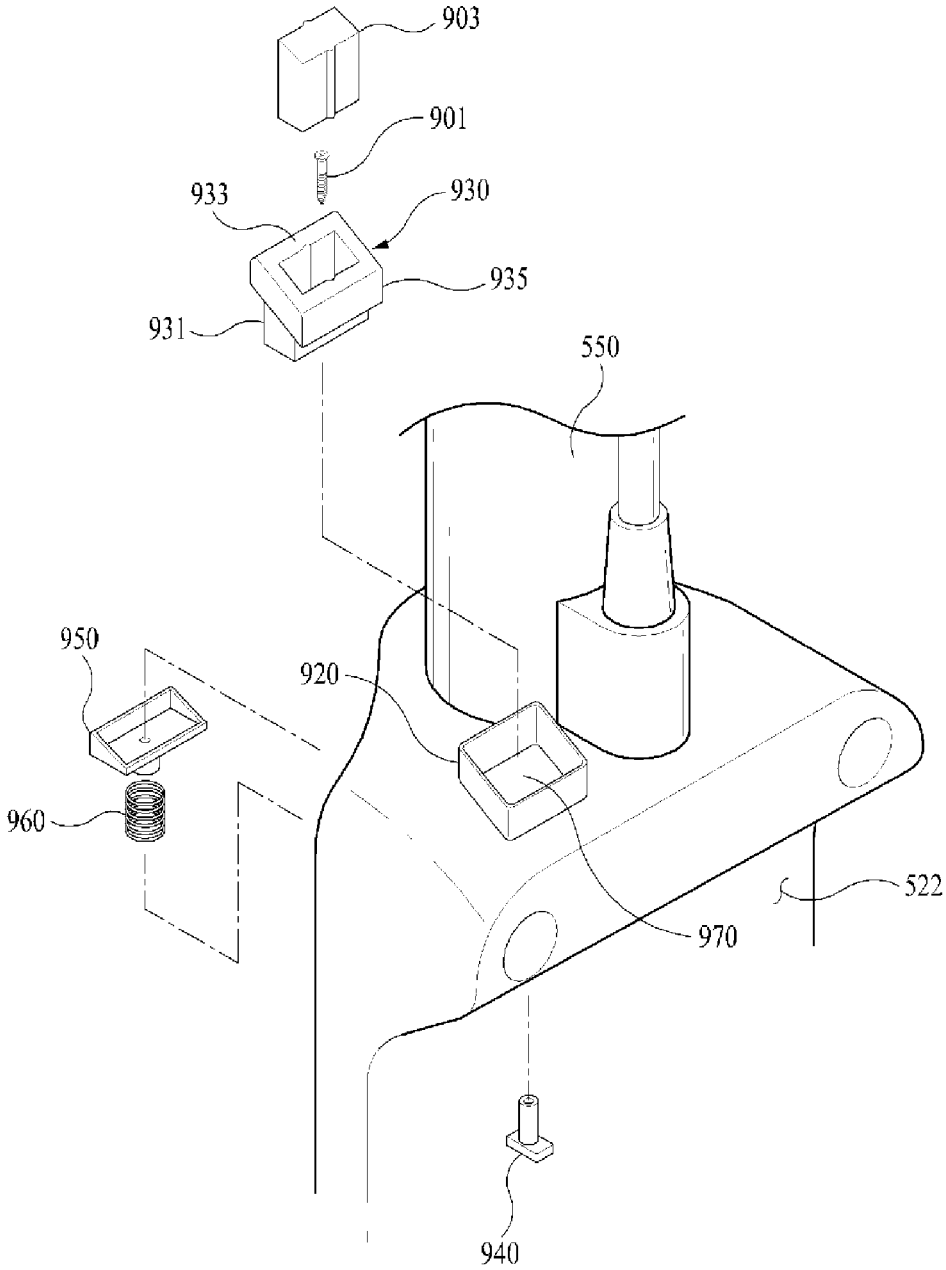
FIG. 12 is an exploded rear perspective view of a manually depressible release button for a water bag.
Figure 13:
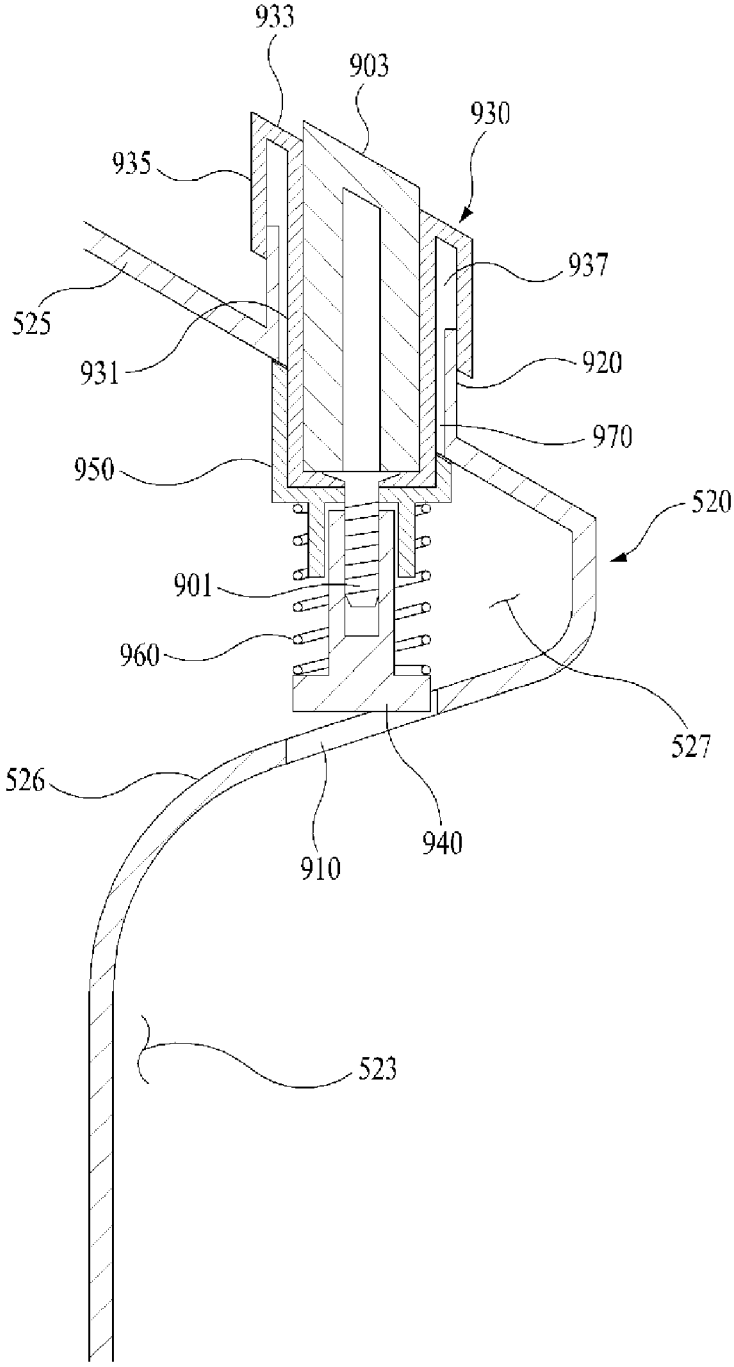
FIG. 13 is an assembled sectional view of FIG. 12.

Referring to FIG. 12 and FIG. 13, the detachable member 900 is constituted by a dorm shaped button 930 enclosing the outer and inner sides of a guide 920 that is protrusively formed at the rear mount case 520, a pushing piece 940 for pushing the fastening projection 571*a* of the water bag 571, a separation prevention piece 950 for preventing the separation of the pushing piece 940, and a spring 960 interposed between the separation prevention piece 950 and the pushing piece 940.

The button 930 is disposed at an upper through hole 970 formed at an upper frame 525 of the rear mount case 520, and the pushing piece 940 is disposed at a lower through hole 910 formed at a lower frame 526 of the rear mount case 520. Thus, a space 527 where the separation prevention piece 950 is held is created between the upper frame 525 and the lower frame 526.

This upper-lower frame structure creates the space 527 for the detachable member 900 at the inner face of the rear mount case 520, and the water mount space 522 at the outer face the rear mount case 520. This is desirable from the perspective of saving the mount space for the water bag 571 and the detachable member 900.

The dorm type button 930 is composed of a body 931, a horizontally extended portion 933 extending in a horizontal direction from the body 931, and a vertically extended portion 935 extending in a vertical direction from a free end of the horizontally extended portion 933.

According to the dorm configuration, a groove 937 between the horizontally extended portion 933 and the vertically extended portion 935 encloses the outside and inside of a guide 920 which is protruded upwardly from the upper frame 525.

This structure protects the housings 510 and 510 from water invasion via a through hole 970, and effectively prevents a possible accident of electric shock received by a person who conducts an electric shock test by spraying water thereto.

The separation prevention piece 950 is prevented from being separated upwardly as its upper end is blocked by the upper frame 525.

Preferably, the button 930, the pushing piece 940, and the separation prevention piece 950 are coupled together by means of a piece 901.

To prevent water invasion into the piece 901 area, a packing 903 is inserted into a center hollow portion of the button 930.

To see how the detachable member 900 works, the water bag 571 being installed makes the fastening projection 571*a* to be inserted into the through hole 910. In this state, when the button 930 is pressed, it descends along the guide 920 and pushes the fastening projection 571*a* with the pushing piece 940. Here, the portion of the fastening projection 571*a* pushed by the pushing piece 940 is tilted. Thus, when the fastening projection 571*a* is pushed by this tiled portion, the water bag 571 comes out automatically at user's convenience. As such, the fastening projection 571*a* escapes from the through hole 910, and the water bag 571 is easily detached by pulling.

Figure 11:
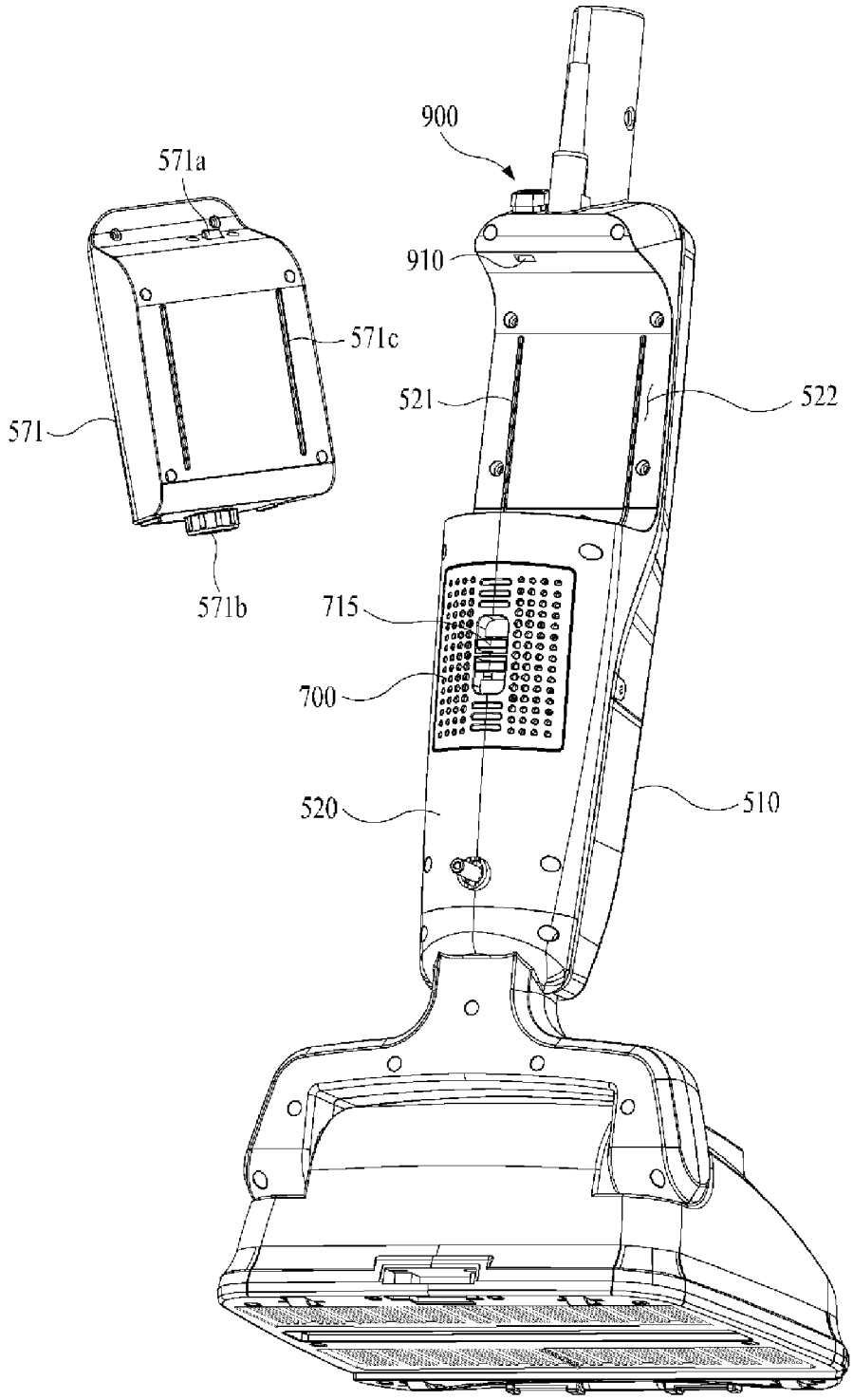
FIG. 11 is an exploded rear perspective view of the steam vacuum cleaner having a water bag being detached therefrom.
Figure 14:
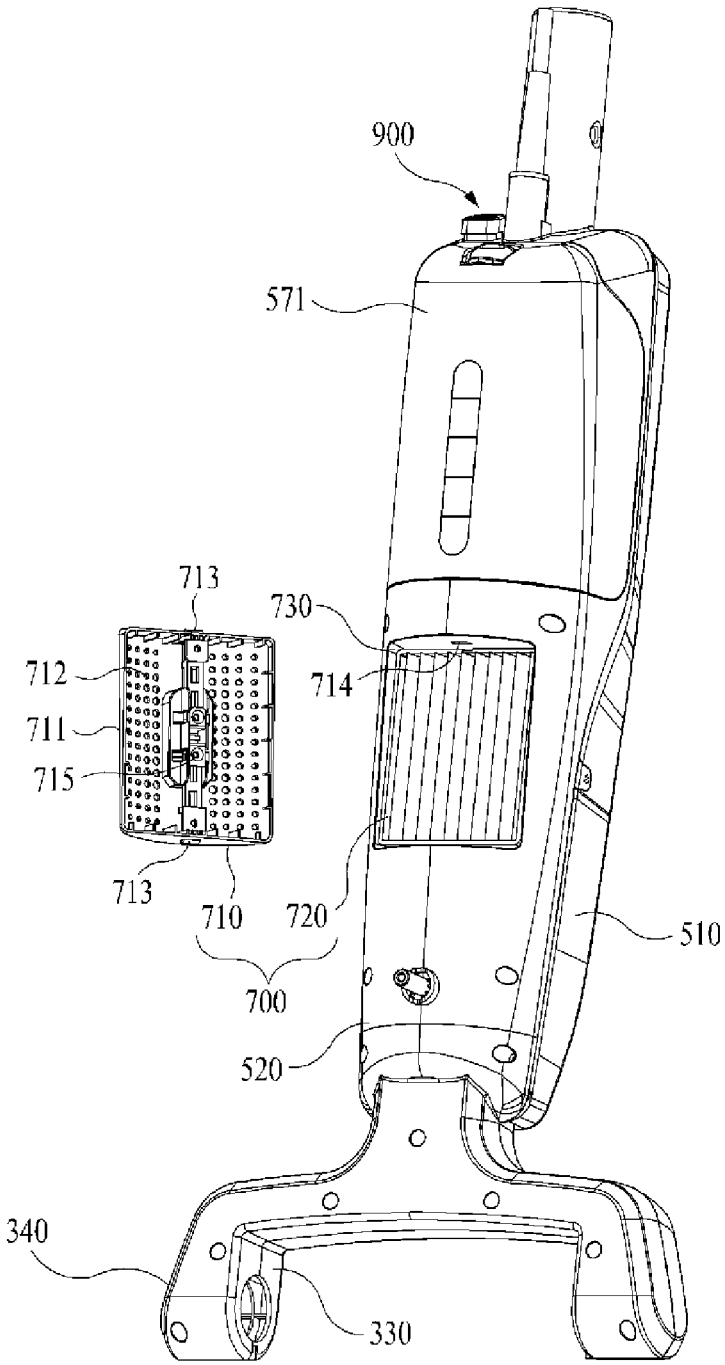
FIG. 14 is a rear perspective view of the steam vacuum cleaner having the cover of an exhaust being opened.

Referring to FIG. 10, FIG. 11, and FIG. 14, the exhaust section 700 is composed of an exhaust groove 730 formed at the rear mount case 520, a filter 720 mounted to the exhaust groove 730, and a filter cover 710 for closing/opening the exhaust groove 730.

Since the exhaust groove 730 is formed in communication with the front mount case 510, it is preferable to be formed into a net shape frame to be able to prevent the separation of the filter 720.

The filter 720 is preferably a HEPA filter to be able to filter fine dust and discharge exhausted gas to outside after sucking in the exhausted gas once. In this way, air discharge rate is reduced, noise is reduced to lower levels, and floor dust is not scattered by the discharged air flow. In particular, since the exhaust section 700 is disposed at the main assembly 500, being away from the floor, it hardly causes the floor dust to fly around.

The filter cover 710 is composed of a cover plate 711 provided with an exhaust hole 712, a detachable projection 713 formed at the upper and lower faces of the cover plate 711, and an operation unit 715 for operating the detachable projection 713.

The detachable projection 713 is inserted into a locking groove 714 formed at the upper and lower inner circumference faces of the exhaust groove 730.

The operation unit 715 is composed of a switch used to pull the detachable projection 713 and recess it toward the cover plate 711, and a spring that is bounced out toward the surface by the detachable projection 713 when the switch is released. The operation unit 715 has similar functions to the detachable member 900 of the water bag 571.

While the present invention has been described with respect to the specific embodiments, it will be apparent to those skilled in the art that various changes and modifications may be made without departing from the spirit and scope of the invention as defined in the following claims. For instance, although the steam vacuum cleaner according to the preferred embodiment of the present invention is configured in three parts: a base assembly, a neck assembly, and it may comprise only two parts: a base assembly and a mop handle assembly. Here, the mop handle assembly includes a mopstick with one end being rotatably supported to the base assembly. Further, a steam generator 570 may be provided on the mopstick, and a dust collecting channel may be formed outside or inside the mopstick.

As explained so far, the steam vacuum cleaner of the present invention has the following advantages.

First, the configuration of the steam vacuum cleaner is characterized by installing the steam generator connected to steam injection port at the base assembly, while installing the motor for sucking air in through the suction nozzle at the main assembly. Therefore, even though the suction capacity of the motor may be increased, making the motor bulky, it does not affect height of the base assembly. In other words, it becomes relatively easier to clean the floor and under the bed, desk, or couch, or any gaps therebetween.

Second, a cord reel wound around the cord used for supplying power to the steam generator and the motor is installed at the main assembly. Thus, the cord can be kept neatly inside the cleaner.

Third, a cord reel mount support frame is further provided to the main assembly to support the cord reel more stably.

Fourth, a withdrawal hole from which the cord is extended is formed at the main assembly, and a recessed groove to which a plug is to be arranged by a plug guide divider is formed around the withdrawal hole. This structure helps the user to easily put the plug outside while the cord reel being installed in the housing, and easily pull and withdraw the cord without letting the plug protruded outwardly.

Fifth, by forming a partition at the plug guide divider, the cord cannot be brought in touch with the motor.

Sixth, the main assembly further includes a built-in pipe to enable attachment and detachment of the mop handle, such that the pipe supports the load of the main assembly and endurance thereof is enhanced.

What is claimed is:

1. A steam vacuum cleaner, comprising:

a base assembly;

a main assembly including a steam generator; and a neck assembly for connecting the main assembly rotatable with respect to the base assembly, wherein the main assembly is provided with an exhaust duct to exhaust discharged air from the base assembly to outside via the neck assembly, the exhaust duct comprising an exhaust groove formed at the main assembly, a filter mounted to the exhaust groove, and a filter cover for opening/closing the exhaust groove.

2. The steam vacuum cleaner according to claim 1, wherein the filter cover is comprised of a cover plate provided with an exhaust hole, a detachable projection formed at the upper and lower faces of the cover plate to be lodged into a groove formed at the upper and lower faces inside the exhaust groove, and an operation unit for operating the detachable projection.

* * * * *